US007730692B1

(12) United States Patent
Hershey

(10) Patent No.: US 7,730,692 B1
(45) Date of Patent: Jun. 8, 2010

(54) TRUSS BEARING

(75) Inventor: Donald W. Hershey, Peoria, AZ (US)

(73) Assignee: Alliance Trutrus, LLC, Phoenix, AZ (US)

( * ) Notice: Subject to any disclaimer, the term of this patent is extended or adjusted under 35 U.S.C. 154(b) by 1099 days.

(21) Appl. No.: 11/278,805

(22) Filed: Apr. 5, 2006

(51) Int. Cl.
*E04B 1/18* (2006.01)
*E04H 12/00* (2006.01)

(52) U.S. Cl. ..... 52/634; 52/632; 52/633; 52/649.6; 52/648.1; 52/289; 52/690; 52/691; 52/692; 52/693

(58) Field of Classification Search ..... 52/632–638, 52/649.6, 648.1, 289, 690–693, 93.2, 642, 52/654.1
See application file for complete search history.

(56) References Cited

U.S. PATENT DOCUMENTS

| | | | | | |
|---|---|---|---|---|---|
| 797,474 | A | * | 8/1905 | Walker | 52/63 |
| 1,680,976 | A | * | 8/1928 | Frease | 52/634 |
| 2,770,846 | A | * | 11/1956 | Findleton | 52/642 |
| 3,527,007 | A | * | 9/1970 | McManus | 52/327 |
| 4,077,176 | A | | 3/1978 | Bauer | |
| 4,104,843 | A | | 8/1978 | Gilb | |
| 4,274,241 | A | * | 6/1981 | Lindal | 52/642 |
| 4,630,424 | A | * | 12/1986 | Eberle et al. | 52/693 |
| 4,641,480 | A | * | 2/1987 | Mort | 52/693 |
| 4,653,237 | A | | 3/1987 | Taft | |
| 4,677,806 | A | * | 7/1987 | Tuomi | 52/656.1 |
| 4,682,460 | A | | 7/1987 | Reetz | |
| 4,745,724 | A | | 5/1988 | Reetz | |
| 5,253,465 | A | | 10/1993 | Gilb | |
| 5,285,607 | A | | 2/1994 | Somerville | |
| 5,341,619 | A | | 8/1994 | Dunagan et al. | |
| 5,546,726 | A | * | 8/1996 | Stalzer | 52/702 |
| 5,560,177 | A | * | 10/1996 | Brightwell | 52/841 |
| 5,640,822 | A | * | 6/1997 | Haswell | 52/712 |
| 5,761,872 | A | * | 6/1998 | Sanford et al. | 52/694 |
| 6,584,741 | B1 | * | 7/2003 | Hatzinikolas | 52/289 |
| 6,655,096 | B1 | * | 12/2003 | Pryor | 52/92.2 |
| 6,874,294 | B2 | | 4/2005 | Masterson et al. | |
| 6,993,880 | B2 | | 2/2006 | Cameron et al. | |
| 2004/0079034 | A1 | * | 4/2004 | Leek | 52/92.2 |
| 2004/0107660 | A1 | | 6/2004 | Moreau | |
| 2005/0188638 | A1 | * | 9/2005 | Pace | 52/414 |
| 2007/0213960 | A1 | * | 9/2007 | Freet | 703/1 |
| 2008/0060283 | A1 | * | 3/2008 | Aranda | 52/79.11 |
| 2008/0141612 | A1 | * | 6/2008 | Schierding | 52/634 |

* cited by examiner

*Primary Examiner*—Richard E Chilcot, Jr.
*Assistant Examiner*—Mark R Wendell
(74) *Attorney, Agent, or Firm*—Louis J. Hoffman; David S. Alavi

(57) ABSTRACT

A truss bearing supports a web-type construction truss and has an elongated metal member that is secured along its length to the primary supporting chord of a truss. The truss bearing can include a pair of substantially parallel spaced-apart elongated wooden members sandwiching the metal member extending along and secured to the bottom of the primary chord, with the metal member adhesively secured to the primary chord through being adhesively secured to the pair of wooden members. An optional metal bearing plate can be substantially rigidly secured to the bottom surface of the elongated metal member near one or both ends of the truss, forming therewith a T-shaped cross-section, and can be welded to a supporting member of a larger structure using metal-to-metal connection. The bearing plate can have an angled extension affixed to the first diagonal truss member.

20 Claims, 5 Drawing Sheets

TRUSS BEARING

BACKGROUND

The field of the present invention relates to trusses used to support elements of buildings or other structures. A truss bearing is disclosed for securing a wooden truss chord to a metal support.

A truss typically includes horizontal, parallel upper and lower truss chords (i.e., beams) connected by a truss web, which has a plurality of diagonal or vertical (or both) web members. Such trusses are intended to support vertical loads and are in turn typically supported at the ends of the upper truss chord by beams, girders, ledgers, other trusses, or other supporting or structural members when incorporated into a larger structure that supports the truss. The chord and web configuration results in a highly rigid truss capable of supporting large vertical loads. Longitudinal or lateral loads (i.e., shearing loads), however, are borne by the connection or linkage between the ends of the upper chord and whatever supporting members support its ends. Such connections or linkages may be a weak point of a structure, and may fail when the structure is subject to shearing forces (during an earthquake, for example).

Wood is a common material used for making trusses. Securing the ends of the truss to another supporting member typically involves nails, screws, bolts, or other fasteners inserted through the end of the upper chord. To meet increasingly stringent construction standards for resisting shear loads, larger numbers of such fasteners must be used, to the point where the structural integrity of the wood forming the upper truss chord may be compromised.

SUMMARY

An improved truss system includes (aside from the usual truss web connecting upper and lower truss chords) a novel truss bearing at one or both ends of the upper, primary supporting truss chord. Specifically, a segment of the upper truss chord extends beyond the truss web at an end of the truss. The truss bearing comprises an elongated metal member that is secured along a substantial portion of its length to the primary supporting chord at a bottom surface of the chord. The truss bearing can further include a pair of substantially parallel spaced-apart elongated wooden members, one on either side of the elongated metal member, that extend along and are secured to the bottom surface of the primary supporting chord, with the elongated metal member adhesively secured to the primary supporting chord through being adhesively secured to the pair of wooden members. The truss bearing can further include a metal bearing plate with a surface substantially rigidly secured to the bottom surface of the elongated metal member near an end of the truss, which can be welded to a supporting member of a larger structure, using metal-to-metal connection.

A method for forming the truss or modifying a conventionally constructed truss comprises securing the elongated metal member to the wooden primary supporting chord. The method can further comprise securing the elongated wooden members to the primary supporting chord and adhesively securing the elongated metal member to both elongated wooden members. The method can further include welding the surface of the metal bearing plate to the elongated metal member below the end of the primary supporting chord.

Objects and advantages pertaining to truss support structures may become apparent upon referring to the exemplary embodiments illustrated in the drawings and disclosed in the following written description or claims. Exemplary embodiments are described below in the drawings and detailed description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase.

Likewise, the use of the words "function" or "means" or any functional language in the detailed description or claims is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the claimed inventions, the claims will specifically recite the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the claimed inventions, it is intended that the claimed inventions not be limited only to the specific structure, material, or acts that are described in the exemplary embodiments, but in addition, include any and all structures, materials, or acts that perform the claimed function, along with any and all known or later-developed equivalent structures, materials, or acts for performing the claimed function. It is not intended to exclude from the scope of the claims the use of structures, materials, or acts that are not expressly identified in the specification but are capable nonetheless of performing a claimed function.

Figure 1:
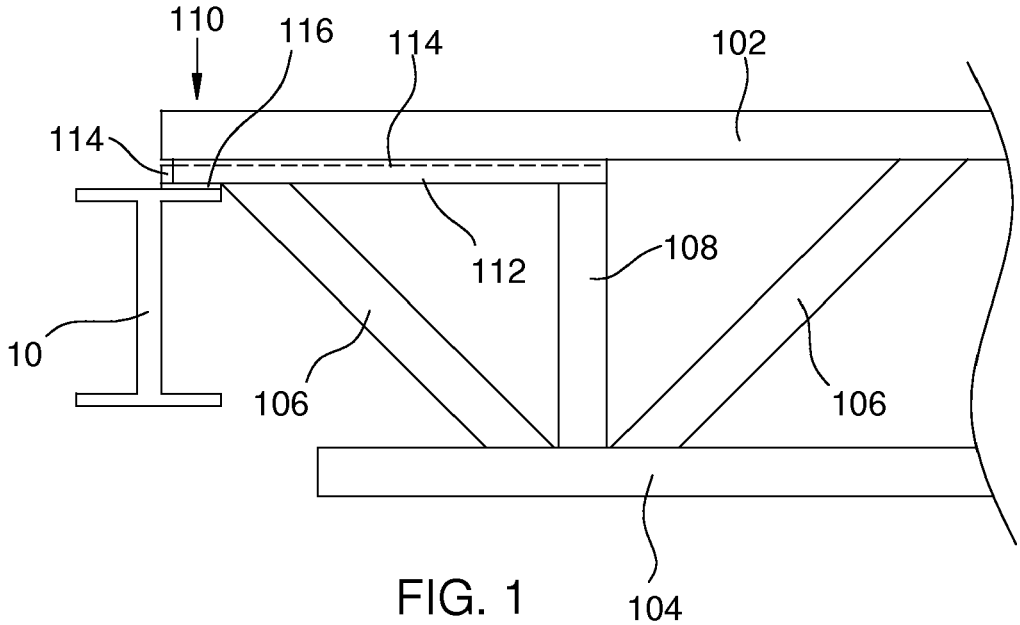
FIGS. 1 and 2 are schematic side views of an exemplary embodiment of a truss with a truss bearing.

The embodiments shown and described in the drawings and description are exemplary and should not be construed as limiting the scope of the present disclosure or appended claims. Distances, sizes, thicknesses, proportions, and so forth may be distorted for clarity and shall not be construed as limiting the scope of the present disclosure or appended claims.

DETAILED DESCRIPTION OF EMBODIMENTS

An end of a truss 100 with an exemplary embodiment of a truss bearing is shown in FIG. 1. Truss 100 has an upper wooden truss chord 102 (i.e., the primary supporting chord of truss 100) and a substantially parallel lower truss chord 104. A truss web connects upper and lower truss chords 102 and 104 and comprises a plurality of diagonal truss members 106. Each diagonal truss member 106 is connected at its ends to truss chords 102 and 104. The first diagonal truss member 106 at the end of truss 100 is connected to upper truss chord 102 at a point farther from the center of the truss than its connection point to lower truss chord 104 (i.e., the first diagonal truss member at the end of the truss slopes upward and outward). The truss web can optionally further include vertical truss members 108. Lower truss chord 104 or truss web members 106 (or 108, if present) may also comprise wooden members or may comprise any other suitably rigid structural material.

In typical trusses, upper truss chord 102 acts as the primary supporting beam for the truss. A truss-bearing segment 110 of upper truss chord 102 extends beyond the truss web at each end of the truss and is the portion of truss 100 that is typically supported by another support member such as a beam, a ledger, a steel girder, another truss, and so on (generally designated 10 in the drawings) when truss 100 is installed as a component of a larger structure that supports the truss.

A truss bearing is formed at an end of truss 100 for enabling attachment of the truss with wooden upper truss chord 102 to supporting member 10. A truss bearing can be formed at one or both ends of truss 100. The truss bearing (in FIG. 1 embodiment, shown in more detail in FIGS. 3 and 4) comprises a pair of substantially parallel spaced-apart elongated wooden members 112, an elongated metal member 114, and a metal bearing plate 116. Elongated wooden members 112 are arranged substantially parallel to upper truss chord 102 and are secured in any suitable way to its bottom surface near its end. Elongated metal member 114 is arranged substantially parallel to upper truss chord 102 between elongated wooden members 112 and preferably secured by adhesive to elongated members 112. Elongated metal member 114 extends along a portion of upper truss chord 102 that includes truss-bearing segment 110. Metal bearing plate 116 has a surface substantially rigidly secured (e.g., by welding) to elongated metal member 114 below truss-bearing segment 110 of upper truss chord 102. Alternatively, metal bearing plate 116 and elongated metal member 114 can be formed integrally with each other, such as by casting. Elongated metal member 114 and metal bearing plate 116 are preferably made of steel; other structurally suitable metal or alternative materials (e.g., high-strength fiberglass or ceramics) could be employed. Upon installation of truss 100, metal bearing plate 116 is be secured to supporting member 10, specifically by welding or other substantially rigid securing process such as through-hole bolts.

Elongated metal member 114 can be secured to elongated wooden members 112 using epoxy-based adhesive or any other adhesive suitable for adhering wood to metal. Use of adhesive avoids damage to the structural integrity of wooden upper truss chord 102 or elongated wooden members 112 that can result from use of nails, screws, bolts, or other penetrating fasteners. In a method for forming a truss with a truss bearing or for modifying a conventionally constructed truss to include a truss bearing, one wooden member 112 can be secured to upper truss chord 102 first, followed by adhesively securing metal member 114 to the wooden member 112, followed by securing the second wooden member 112. Alternatively, wooden members 112 and metal member 114 can first be adhesively secured together to create a sandwiched assembly, which can in turn be secured to the bottom surface of upper truss chord 102. Metal bearing plate 116 can be secured to elongated metal member 114 before or after member 114 is secured to wooden members 112.

Figure 3:
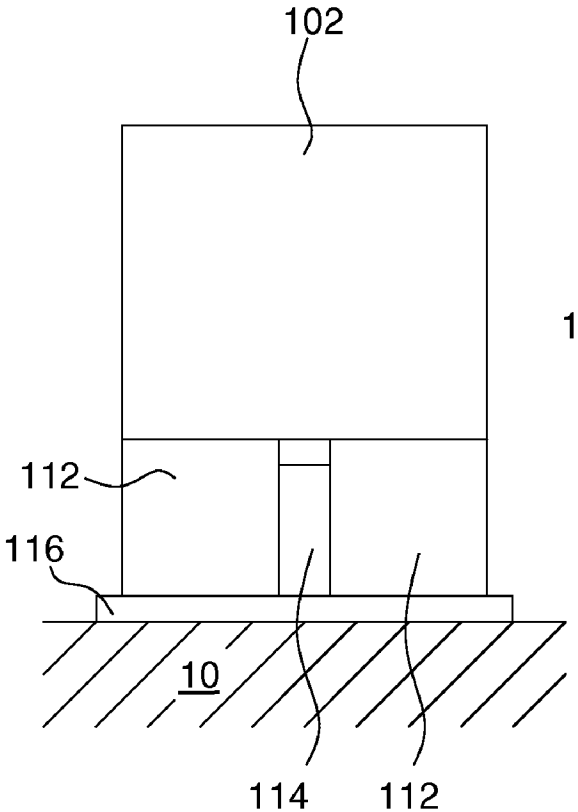
FIG. 3 is a schematic end view of the embodiment of FIG. 1.
Figure 4:
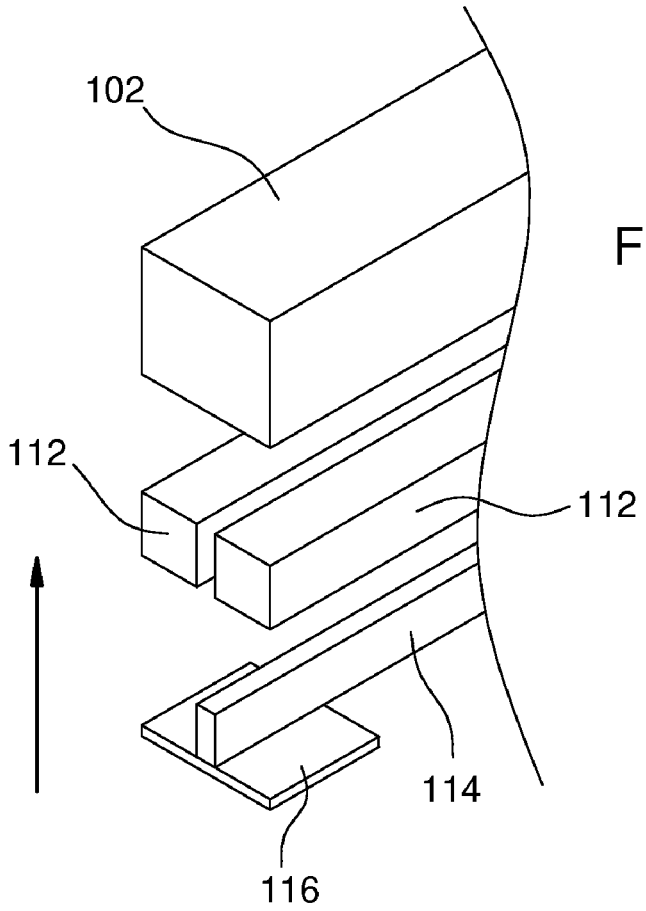
FIG. 4 is a schematic exploded view of the embodiment of FIG. 1.

As best seen in the end view of FIG. 3, elongated metal member 114 can be slightly shorter than elongated wooden members 112 (e.g., member 114 is slightly less than 1.5 inches high, e.g., about 1.25 inches high, as compared to members 114 being 2×2 dimensional boards, which are typically about 1.5 inches square) so as to leave a small clearance or gap between the top of elongated metal member 114 and wooden truss chord 102. The bottom surface of elongated metal member 114 is substantially flush with the bottom surfaces of elongated wooden members 112, so that metal bearing plate 116 is positioned against the bottom surfaces of members 112. Vertical loads on truss 100 are transmitted to supporting member 10 through wooden upper truss chord 102, elongated wooden members 112, and metal bearing plate 116 to supporting member 10. The gap between the top of elongated metal member 114 and the bottom of upper truss chord 102 ensures that a vertical load is borne primarily by elongated wooden members 112 until compression of wooden members 112 between truss chord 102 and metal bearing plate 116 by the vertical load brings upper truss chord 102 into contact with elongated metal member 114. Once in contact with upper truss chord 102, elongated metal member 114 contributes in bearing the vertical load. Slightly compressed wooden members 112 are believed to provide added support for the vertical load, as opposed to a hypothetical system that omitted members 112. This added support increases the overall vertical load capacity of truss 100, decreases the likelihood that the vertical load localized on the top of metal member 114 will split truss chord 102 lengthwise, and guards against rotation of truss member 102 around a fulcrum formed by elongated metal member 114.

Elongated metal member 114 should be sufficiently wide to adequate support required or desired vertical loads on truss 100. Half-inch steel bar stock, resulting in a width of about 0.5 inches for metal member 114, provides sufficient load capacity for typical loads borne by truss 100 without substantially adding to the weight or expense of truss 100. Other widths can be employed that are consistent with the load-bearing capacity required or desired of truss 100 and material properties of metal member 114. Larger widths for metal member 114 (up to the width of upper truss chord 102, for example, which would eliminate the need for wooden members 112) can increase the vertical load capacity at the expense of greater truss weight or greater expense. Such a widened elongated metal member 114 can in some circumstances be directly attached to supporting member 10 without using bearing plate 116. A wider elongated member 114 delocalizes load forces transmitted from upper truss chord 102, decreasing the likelihood that the wooden upper truss chord 102 will split lengthwise under the load.

In various alternative embodiments, an elongated metal member 114 having a non-rectangular cross-sectional shape can be employed. For example, an inverted trapezoidal cross-sectional shape can be employed, and the widened upper surface delocalizes vertical loads transmitted from the upper truss chord. Other suitable shapes can be employed. Another alternative embodiment can utilize an elongated metal member 114 having a cross-sectional shape that is not constant along its length. For example, the end of metal member 114 can be flattened in the section adjacent to plate 116, giving it a kind of crowbar appearance that allows for a smoother transition to plate 116 (or replacement of plate 116). In another alternative embodiment, elongated member 114 can be secured to upper chord 102 by inserting it in a slot or keyway, such as formed with a router, in which case the flat inside surface of such a slot would be considered a bottom surface of chord 102.

Extension of elongated member 114 a substantial distance along upper truss chord 102 enables its attachment to upper truss chord 102 with adhesive (directly to chord 102 or indirectly via elongated wooden members 112), while allowing enough surface area to allow the adhesive to withstand both vertical loading as well as longitudinal loads (shear forces applied along truss 100) at the metal-wood bond. Sandwiching elongated metal member 114 between elongated wood members 112 along the substantial distance along upper truss chord 102 also serves to reduce or prevent twisting or lateral movement of elongated metal member 114 in response to lateral loads (shear force applied across truss 100).

Elongated members 112 and 114 can typically extend along the upper truss chord 102 at least as far as the position of the first vertical truss member 108 (if present), and they can extend substantially further than that. One embodiment has a length in a preferred range of about 30 to about 36 inches. Extension of members 112 and 114 to at least the position of the first vertical truss member 108 enables a common attachment for wooden elongated members 112 and vertical truss member 108 to upper truss chord 102 (see below). Other distances (larger or smaller) can be used and may depend in part on the vertical or shear loads a given truss is expected to withstand.

Thus secured to wooden upper truss chord 102 in a manner to resist shear loads, metal bearing plate 116 can be secured strongly to supporting member 10, also in a manner suitable for resisting shear loads. For example, metal bearing plate can be welded directly to metal supporting member 10 or can be secured to supporting member 10 with screws or bolts. Metal bearing plate 106 can be substantially the same width as upper truss chord 102, or it may be wider than wooden upper truss chord 102, such as to provide a larger area for welding. In some instances, penetrating fasteners sufficiently numerous to provide desired or required shear strength may degrade the structural integrity of metal bearing plate 116 far less than they would degrade wooden upper truss chord 102 of a conventionally mounted truss.

In conventional trusses, metal gusset plates 118 are often employed (typically as opposed pairs) for connecting diagonal truss members 106 (and vertical members 108, if present) to upper and lower truss chords 102 and 104. Gusset plates 118 are shown only in FIG. 5; they are omitted from the other drawings for clarity. Gusset plates typically employed comprise 20-, 18-, or 16-gauge galvanized steel plates; other suitable gusset plates can be employed. In a truss having a truss bearing as disclosed herein, wooden members 112 and metal member 114 are typically interposed between upper truss chord 102 and the upper end of the last diagonal truss member 106, so that the upper end of the first diagonal truss member 106 is typically secured indirectly to upper truss chord 102 through its connection to elongated wooden members 112. Similarly, wooden members 112 and metal member 114 are typically interposed between upper truss chord 102 and vertical truss member 108 (if present).

In one example (shown in FIG. 5), a first gusset plate 118 (or opposed pair) can be employed that spans upper truss chord 102, elongated wooden member 112, and an upper portion of the first diagonal truss member 106, and another gusset plate 118 (or opposed pair) can be employed that spans upper truss chord 102, elongated wooden member 112, and an upper portion of vertical member 108. The gusset plates therefore serve both to secure truss members 106 and 108 to upper truss chord 102 and to secure elongated wooden members 112 to upper truss chord 102, and therefore to secure metal member 114 to chord 102. Alternatively, truss members 106 (and 108, if present) can be connected to truss chords in any other suitable way, which in turn can be suitably adapted for connecting the upper end of the last diagonal or vertical truss member 106 or 108 to upper truss chord 102 directly or indirectly (and perhaps also securing members 112 to chord 102). Independently of the manner in which truss members 106 or 108 are connected to truss chord 102, elongated members 112 and 114 can be secured to truss chord 102 in any suitable manner, including but not limited to gusset plates, adhesive, bolts, screws, nails, other penetrating connectors, and so on.

Figure 2:
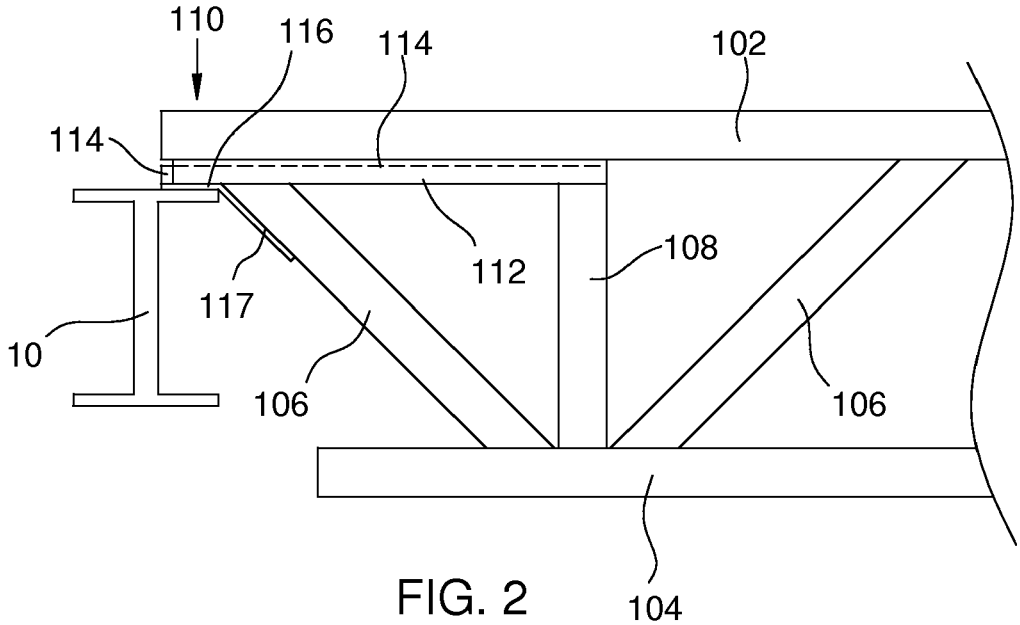
Figure 5:
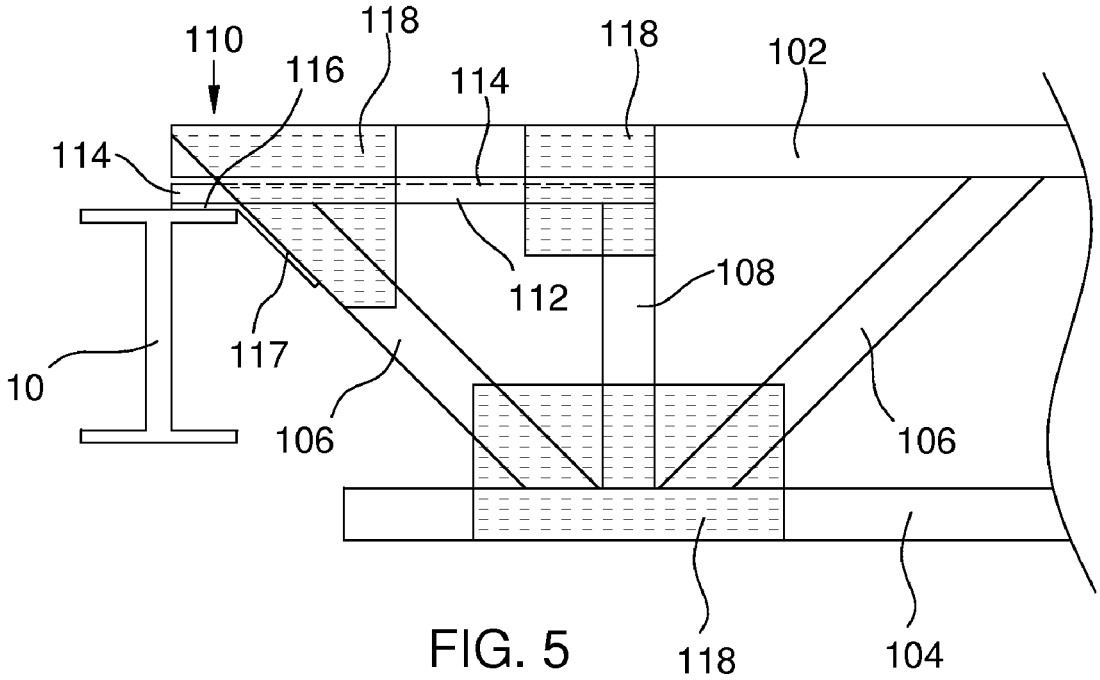
FIG. 5 is a schematic side view of an exemplary embodiment of a truss with a truss bearing.

In another exemplary embodiment of truss 100 with a truss bearing, metal bearing plate 116 can include an extension angled downward at about the same angle as diagonal truss member 106 at the end of truss 100 to form flange plate 117 (best seen in FIGS. 2 and 5). Flange plate 117 is secured to the first diagonal truss member 106 by screws, bolts, nails, adhesive, or other suitable fasteners. Flange plate 117 serves to assist in the transfer of loads on truss 100 to supporting member 10 through diagonal truss member 106, while strengthening the attachment of the first diagonal truss member 106 to wooden upper truss chord 102.

Figure 7:
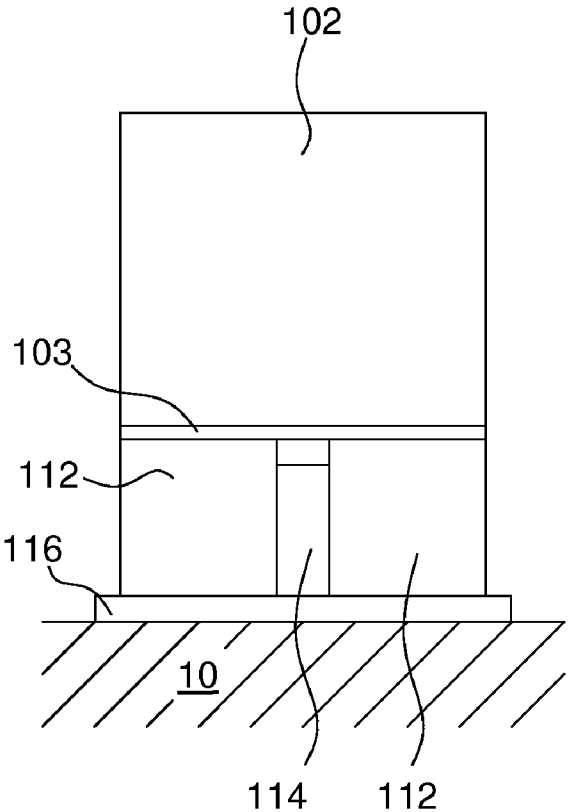
FIGS. 6 and 7 are schematic end views of additional exemplary embodiments of a truss with a truss bearing.
Figure 6:
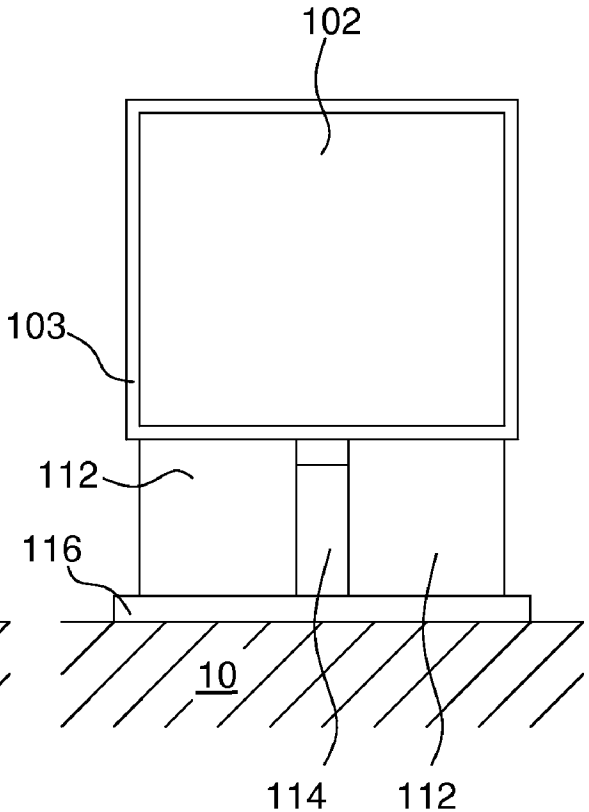

In another exemplary embodiment of a truss with truss bearings, a segment at the end of wooden upper truss chord 102 can be encased on all sides with metal plating or sheathing 103 (FIG. 6), or only the bottom surface of wooden upper truss chord 102 can be sheathed or plated (FIG. 7). In either of those cases, elongated members 112 can be secured indirectly to upper truss chord 102 by gusset plates 108, or by being secured directly to plating or sheathing 103. Plating or sheathing 103 on the bottom of wooden upper truss chord 102 adjacent to elongated metal member 114 can reduce the likelihood of splitting or other damaging of upper truss chord 102 by metal member 114 when a vertical load applied to truss 100 is at least partly borne by elongated metal member 114. Sheathing or plating 103 can comprise one or more gusset plates secured to wooden upper truss chord 102 in the usual way, or can comprise one or more metal plates secured to upper truss chord 102 by adhesive, or can comprise any suitable metal plating secured to upper truss chord 102 in any suitable manner.

Figure 8:
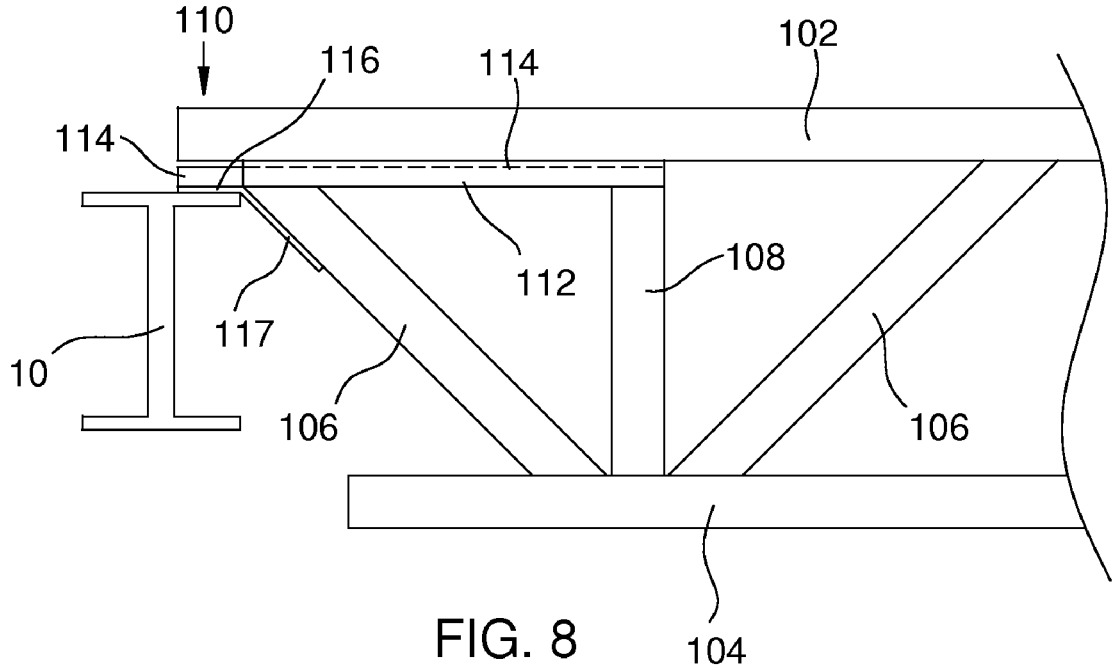
FIGS. 8 and 9 are schematic side views of additional exemplary embodiments of a truss with a truss bearing.
Figure 9:
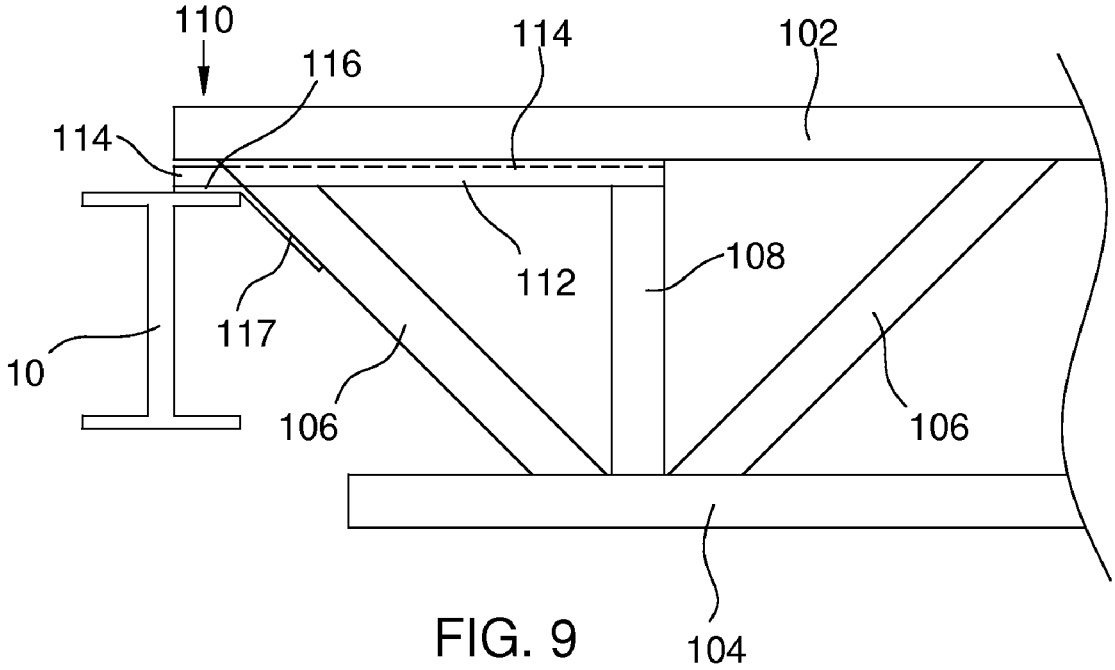

In various exemplary embodiments, elongated wooden members 112 do not extend into the region above metal bearing plate 116 (as in FIG. 8), or members 112 can extend only partly into that region or can be shaped in that region so as to leave exposed at least a portion of the top surface of bearing plate 116. For example, FIG. 9 shows the ends of elongated wooden members 112 cut in a plane defined by the outside edge of first diagonal truss member 106. Exposure of all or part of the top surface of metal bearing plate 116 enables easier access to bearing plate 116 for securing it to a supporting member 10, e.g., by welding.

In another particular embodiment using readily available materials, wooden upper truss chord 102 comprises a pair of boards (typically 2×4 dimensional lumber) arranged one on top of the other. Elongated wooden members 112 and elongated metal member 114 can have a combined width substantially equal to the width of wooden upper truss chord 102. Those substantially equal widths facilitate use of gusset plates 118 for securing together the truss chord 102, wooden members 112, and diagonal truss member 106. If some means other than a gusset plate is employed, then those widths can more easily differ from one another. In the particular embodiment, using 2×4 boards, the total width would be about 3.5 inches, which can be achieved with wooden members 112 of 2×2 dimensional lumber and metal member 114 formed of half-inch steel bar stock. Bearing plate 116 can be made of quarter-inch steel plate or 3/16-inch steel plate. It should be noted that the actual size of dimensional lumber does not correspond to its nominal dimensions. The actual size is typically one-half inch smaller than the nominal size. Therefore, 2×4 dimensional lumber is actually about 1.5 inches by about 3.5 inches, 2×2 dimensional lumber is about 1.5 inches by about 1.5 inches, and so on. Apparatus and methods disclosed herein are not limited to embodiments employing dimensional lumber.

In alternative embodiments, other sizes or constructions (single board or multiple boards) of wooden upper truss chord 102 can be employed, and other suitable metals or dimensions can be employed for elongated metal member 114 or metal bearing plate 116. In alternative embodiments, the width of wooden upper truss chord 102 can differ from the combined width of elongated wooden members 112 and elongated metal member 114. In an alternative embodiment, wooden upper truss chord 102 and elongated wooden members 112 can be integrally formed, with members 112 formed by milling a slot in the bottom surface of chord 102, the inside of which would constitute a bottom surface of chord 102. The slot cross-section preferably would match the cross-sectional size and shape of elongated metal member 114.

Bearing plate 116 serves as an attachment or linkage point between truss 100 and supporting member 10. As noted above, if the other supporting member 10 is metal, metal bearing plate 116 can be secured thereto by welding; in that case, the truss bearing described herein provides substantial advantages over conventional trusses by allowing metal-to-metal connections at the connection point, which can be stronger and more resistant to shear forces than conventionally used metal-to-wood connections. Metal bearing plate 116 can be secured to any other type of supporting member in any suitable way.

Figure 10:
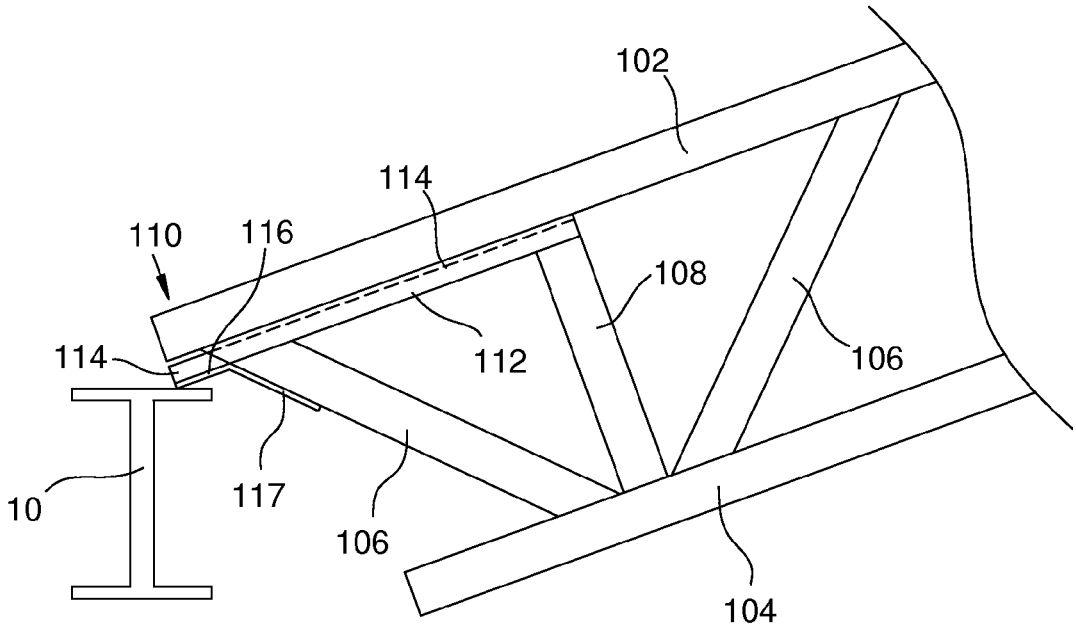
FIGS. 10 and 11 are schematic side views of the embodiment of FIG. 2 installed in non-horizontal orientations.
Figure 11:
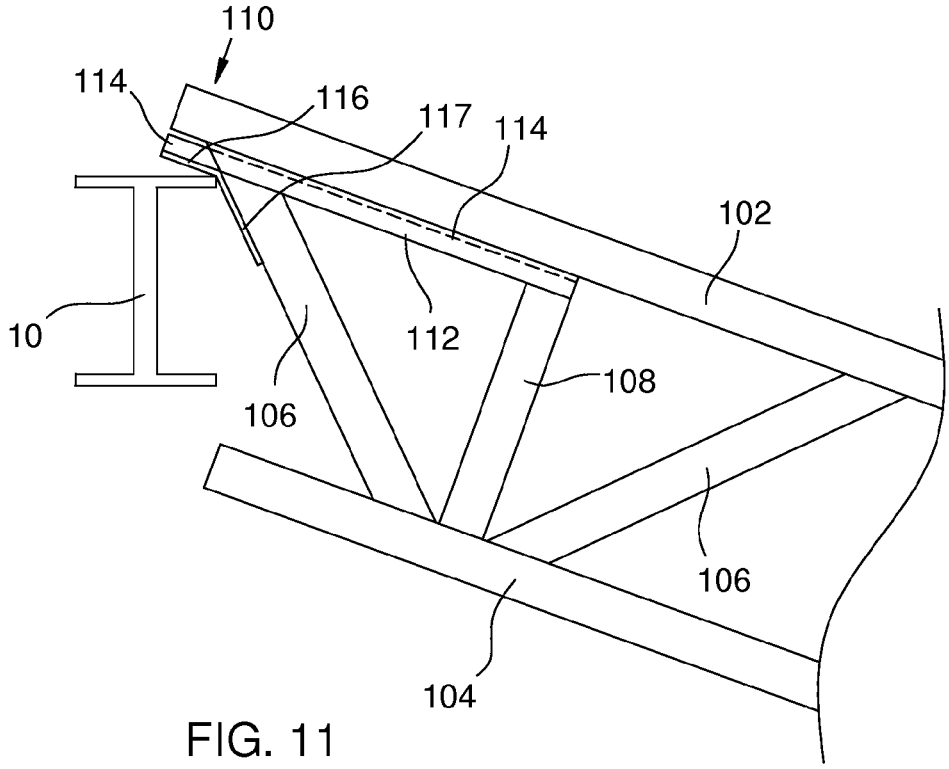

Truss 100 is typically linked to other supporting members in a substantially horizontal orientation with bearing plate 116 substantially flush against a substantially horizontal bearing surface of another supporting member (as in FIGS. 1-3, for example). Alternatively, truss 100 can be installed in a non-horizontal orientation, with metal bearing plate 116 welded to a substantially horizontal bearing surface of another metal supporting member 10 along one of their edges (FIGS. 10 and 11). In modified versions of the truss bearing (not shown), metal bearing plate 116 can have an angled extension below or beyond the end of upper truss chord 102 to engage a horizontal surface of a supporting member, such as a steel ledger, more stably. Non-horizontal installation of truss 100 can prove problematic with only wooden bearing elements at the end of truss 100, which reveals another advantage of the truss bearings disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims. The embodiments disclosed herein should be considered in all respect as being illustrative rather than restrictive of the scope of the appended claims.

What is claimed is:

1. A truss bearing formed as part of a truss having a wooden primary supporting chord, the truss bearing comprising:

(a) an elongated metal member that is secured along a substantial portion of its length to the primary supporting chord of the truss at a bottom surface of the primary supporting chord; and (b) a pair of substantially parallel spaced-apart elongated wooden members, one on either side of the elongated metal member, extending along and secured to the bottom surface of the primary supporting chord near an end of the truss, wherein the elongated metal member is secured to the primary supporting chord through being adhesively secured to the pair of elongated wooden members.

2. The truss bearing of claim 1 wherein the elongated metal member extends beyond the ends of the elongated wooden members near the end of the truss.

3. The truss bearing of claim 1 wherein the elongated metal member is positioned when secured to the elongated wooden members so as to form a gap between the top of the elongated metal member and the bottom of the primary supporting chord.

4. The truss bearing of claim 1 wherein the elongated metal member is further substantially rigidly secured to a supporting member of a structure supporting the truss at a point along the length of the elongated metal member below the end of the primary supporting chord.

5. The truss bearing of claim 1 further comprising a metal bearing plate having a surface substantially rigidly secured to a bottom surface of the elongated metal member at a place near the end of the elongated metal member near an end of the truss.

6. The truss bearing of claim 5 wherein the elongated metal member is substantially rigidly secured to the metal bearing plate below an end of the primary supporting chord, and wherein the bearing plate is substantially rigidly secured to a supporting member of a structure supporting the truss.

7. The truss bearing of claim 5 wherein the elongated metal member and the metal bearing plate are integrally formed.

8. The truss bearing of claim 5 wherein the metal bearing plate includes an integrally formed flange extending at an angle along a diagonal truss member of the truss near the end of the truss and secured to the diagonal truss member.

9. The truss bearing of claim 1 further comprising a protective metal plate along the bottom face of the primary supporting chord, at the portion of the chord along which the elongated metal member extends.

10. The truss bearing of claim 1 wherein the elongated wooden members and the elongated metal member extend along the primary supporting chord at least as far as a position of a first vertical truss member.

11. A truss comprising:

(a) a primary supporting first truss chord;

(b) a second truss chord substantially parallel to the first truss chord;

(c) a plurality of diagonal truss members connecting the first and second truss chords; and (d) at each end of the first truss chord:

(i) an elongated metal member that is secured along a substantial portion of its length to the first truss chord at a bottom surface of the first truss chord;

(ii) a pair of substantially parallel spaced-apart elongated wooden members, one on either side of the elongated metal member, extending along and secured to a bottom surface of the first truss chord near the end of the truss, wherein the elongated metal member is secured to the first truss chord through being adhesively secured to the pair of elongated wooden members; and (iii) a metal bearing plate having a surface substantially rigidly secured to a bottom surface of the elongated metal member at a place near the end of the elongated metal member near the end of the truss.

12. A method for forming a truss or modifying a conventionally constructed truss comprising:

(a) securing an elongated metal member, along a substantial portion of its length, to a wooden primary supporting chord of the truss at a bottom surface of the primary supporting chord; and (b) securing a substantially parallel pair of spaced-apart elongated wooden members, one on either side of the elongated metal member, to the bottom surface of the primary supporting chord, wherein the elongated metal member is secured to the primary supporting chord through being adhesively secured to the pair of elongated wooden members.

13. The method of claim 12 wherein securing the elongated member comprises:

(a) first, adhesively securing the elongated wooden members to the elongated metal member to create a sandwiched assembly, and (b) then securing the sandwiched assembly to the bottom surface of the primary supporting chord.

14. The method of claim 12 wherein the elongated metal member is positioned so as to form a gap between the top of the elongated metal member and the bottom of the primary supporting chord.

15. The method of claim 12 further comprising installing the truss by welding an end of the elongated metal member to a supporting member of a structure supporting the truss.

16. The method of claim 12 further comprising welding a surface of a metal bearing plate to a bottom surface of the elongated metal member below an end of the primary supporting chord and installing the truss by welding the metal bearing plate to a supporting member of a structure supporting the truss.

17. The method of claim 16 wherein securing the elongated member and welding the bearing plate to the elongated member comprises:

(a) first, welding the metal bearing plate to the elongated metal member, (b) then adhesively securing the elongated wooden members to the elongated metal member to create a sandwiched assembly, and (c) then securing the sandwiched assembly to the bottom surface of the primary supporting chord.

18. The method of claim 16 wherein installing the truss by welding the metal bearing plate to the supporting member comprises welding the bearing plate to a surface of the supporting member that is angled with respect to the bottom surface of the primary supporting chord.

19. The method of claim 16 wherein the metal bearing plate includes an integrally formed flange extending at an angle along a diagonal truss member of the truss nearest to the end of the truss and further comprising securing the flange to a surface of the diagonal truss member.

20. The method of claim 12 further comprising metal-encasing at least a portion of the wooden truss primary supporting chord adjacent to the elongated metal member.

* * * * *